US009126703B2

(12) United States Patent
Michels et al.

(10) Patent No.: US 9,126,703 B2
(45) Date of Patent: Sep. 8, 2015

(54) METHOD AND APPARATUS FOR WRAPPING A FOIL AROUND A STACK OF OBJECTS

(75) Inventors: Frank Rolf Michels, Kleve (DE); Norbert Vereulen, Kleve-Warbeyen (DE); Enrico Czok, Kleve (DE); Michael Oymann, Xanten (DE); Serge Alekseew, Kleve (DE)

(73) Assignee: MSK-VERPACKUNGS-SYSTEME GMBH, Kleve (DE)

( * ) Notice: Subject to any disclaimer, the term of this patent is extended or adjusted under 35 U.S.C. 154(b) by 1181 days.

(21) Appl. No.: 13/087,858

(22) Filed: Apr. 15, 2011

(65) Prior Publication Data

US 2011/0258970 A1 Oct. 27, 2011

(30) Foreign Application Priority Data

Apr. 15, 2010 (EP) ..... 10003989

(51) Int. Cl.
*B65B 11/00* (2006.01)
*B65B 9/13* (2006.01)
*B65B 59/02* (2006.01)

(52) U.S. Cl.
CPC ..... *B65B 9/135* (2013.01); *B65B 59/02* (2013.01)

(58) Field of Classification Search
CPC ..... B65B 11/00; B65B 67/08; B65B 11/025; B65B 9/135; B65B 59/02
USPC ..... 53/203, 210, 214, 228, 461, 465, 466, 53/66, 183, 567
See application file for complete search history.

(56) References Cited

U.S. PATENT DOCUMENTS

| | | | | | |
|---|---|---|---|---|---|
| 3,738,079 | A * | 6/1973 | Rudman et al. | 53/66 |
| 3,897,674 | A * | 8/1975 | Higgins | 53/66 |
| 4,050,219 | A * | 9/1977 | Higgins | 53/567 |
| 4,473,990 | A * | 10/1984 | Thimon | 53/567 |
| 4,546,598 | A * | 10/1985 | Karpisek | 53/556 |
| 6,032,439 | A * | 3/2000 | Birkenfeld et al. | 53/441 |
| 2004/0060264 | A1 * | 4/2004 | Miller | 53/461 |
| 2007/0101680 | A1 * | 5/2007 | Murarotto | 53/399 |
| 2009/0272080 | A1 * | 11/2009 | Lachenmeier | 53/461 |
| 2010/0071317 | A1 * | 3/2010 | Michels et al. | 53/441 |
| 2011/0258970 | A1 * | 10/2011 | Michels et al. | 53/461 |

FOREIGN PATENT DOCUMENTS

| | | | |
|---|---|---|---|
| DE | 3941139 | A1 | 6/1991 |
| EP | 0395919 | B1 | 8/1993 |
| EP | 1060988 | B1 | 12/2005 |
| WO | 03062062 | A1 | 7/2003 |

OTHER PUBLICATIONS

Machine English Translation of reference EP 1060988, 6 pages.*

* cited by examiner

*Primary Examiner* — Andrew M Tecco
(74) *Attorney, Agent, or Firm* — Andrew Wilford

(57) ABSTRACT

An apparatus for wrapping a film around each of a sequence of objects passing sequentially through a wrapping station has a supply of the film adjacent the station, a feed head at the station having a base, a support carried on the base and rotatable relative thereto about a vertical axis, and a feeder on the base for pulling the film off the supply and feeding it to the support. A film storer carried on the support is operable to take in and store a length of film fed to the support by the feeder. A pull-down device in the station is vertically displaceable below the feed head.

15 Claims, 6 Drawing Sheets

METHOD AND APPARATUS FOR WRAPPING A FOIL AROUND A STACK OF OBJECTS

FIELD OF THE INVENTION

The present invention relates to a system for wrapping a stack of objects. More particularly this invention concerns a packaging apparatus and method for palletized goods moving on a conveyor.

BACKGROUND OF THE INVENTION

A typical production-packaging apparatus for wrapping a stack of objects with a film has at least one film supply for the film, a film-feed head for feeding the film, and a device for pulling the film down over the stack of objects. The invention further relates to a method of wrapping a stack of objects with a film. Within the scope of the invention, "film" means in particular a plastic film, preferably an elastic thermoplastic film. It is within the scope of the invention that the stack of objects to be wrapped is a stack of products. The stack may also be a single object or whiteware, for example refrigerators or the like. The stack of objects to be wrapped is advantageously accommodated on a pallet.

In practice, it is not uncommon for stacks of objects or pallets carrying these stacks of objects having different orientations to be consecutively supplied to a wrapping station of an apparatus for wrapping the stack of objects. Thus, a stack of objects that in top view are not square or a pallet that in top view is not square having the length/width dimensions L/W is initially supplied and wrapped, and subsequently another stack of objects that has the dimensions W/L and that is rotated by 90° about a vertical axis with respect to the first stack of objects must be supplied and wrapped. Additional measures are necessary here in order to obtain a film or film sheet that in such a case is also optimally adapted to the dimensions of the stack of objects or of the pallet.

In practice it is known, among other things, to lift the stack of objects using the elevator of a shrink-wrapping device and to rotate the stack of objects by 90° for the covering operation. However, this often results the stack of objects falling over, together with product losses and facility down times. It is also known to provide in the conveyor a rotatable table underneath the film-feed head so that the stack of objects may be appropriately rotated. However, constrictions result in the transition regions between the rotatable table and the conveyor edge due to the fact that the pallets associated with the stacks of objects often become stuck at the transitions, and the stacks of objects then frequently fall over. It is also known in practice to design the entire film-feed head to be rotatable by 90° so that the film can always be fed in the desired direction. This approach is relatively complicated, and the process is also too slow, in particular because of the large mass that has to be moved.

It is further known in practice for the film initially to be completely provided in the feed head and welded, and then transferred to a roller and rolled up by the roller. This roller is then rotated by 90° with respect to the direction of transport, and the film is transferred from the roller to the pull-down device. These measures known in practice are also relatively complicated. The multiple transfers of the film result in a relatively high susceptibility to malfunctions.

OBJECTS OF THE INVENTION

It is therefore an object of the present invention to is provide an improved method and apparatus for wrapping a foil around an object or stack of objects.

Another object is the provision of such an improved method and apparatus for wrapping that overcomes the above-given disadvantages, in particular by means of which differently oriented stacks of objects, in particular non-square stacks of objects that are rotated by 90° with respect to one another, may be consecutively wrapped in a simple, less complicated, rapid, and operationally reliable manner.

A further object of the invention is to provide a corresponding method of wrapping stacks of objects.

SUMMARY OF THE INVENTION

An apparatus for wrapping a film around each of a sequence of objects passing sequentially through a wrapping station has according to the invention a supply of the film adjacent the station, a feed head at the station having a base, a support carried on the base and rotatable relative thereto about a vertical axis, and a feeder on the base for pulling the film off the supply and feeding it to the support. A film storer carried on the support is operable to take in and store a length of film fed to the support by the feeder. A pull-down device in the station is vertically displaceable below the feed head.

It is within the scope of the invention that the rotatable support is turned when, after a first stack of objects having a first orientation is wrapped, a second stack of objects having a second orientation different from the orientation of the first stack of objects is to be wrapped, and/or when stacks of objects having different dimensions are to be consecutively wrapped. The rotatable support is turned in particular after a first stack of objects that in top view is not square and that has the dimensions L·W is wrapped, and before a second stack of objects that in top view is not square, and that has the dimensions W·L, and that is rotated by 90° about a vertical axis with respect to the first stack of objects is wrapped. In this regard, L stands in particular for the length of the stack of objects that here is the longer horizontal dimension, and W stands in particular for the width of the stack of objects that here is the shorter horizontal dimension. It is therefore within the scope of the invention that the stacks of objects to be consecutively wrapped may have the same dimensions but are rotated with respect to one another only by 90°. In principle, however, the stacks of objects to be consecutively wrapped may also have different dimensions.

It is also within the scope of the invention that a film section for a subsequent covering operation may be stored in the film storer of the rotatable support. Thus, the film section stored in the film storer should advantageously have a sufficient length for covering a stack of objects. Within the scope of the invention, "covering a stack of objects with the film" in particular also generally means wrapping a stack of objects with a film.

According to the invention, the base of the film-feed head has at least one film feeder for advancing and transporting the film. The base advantageously includes guide rollers and/or deflection rollers for the film, i.e. for the film fed to the film-feed head from the film supply. It is within the scope of the invention that the base of the film-feed head is not rotatable, or is not rotatable relative to the rotatable support.

The rotatable support is advantageously rotatable on the nonrotatable base by at least 90°, i.e. rotatable by 90° relative to the base. It is within the scope of the invention that the rotatable support is rotatable about an axis extending parallel to the covering direction of the film, and is preferably rotatable about a vertical axis. "Covering direction of the film" means the direction in which the film is pulled over the stack of objects using the pull-down device, normally downward.

According to one particularly preferred embodiment of the invention, the rotatable support has a film cutter for separating the film section stored in the film storer. It is within the scope of the invention that the film cutter, as a component of the rotatable support, rotates together with the rotatable support relative to the base. The film cutter is is advantageously designed as a blade.

According to one very preferred embodiment of the invention, the film is designed as a tubular film; i.e. the film may be fed as a tubular film. It is recommended that the tubular film is designed as a side-gusseted tube. In this case, in addition to two superposed film layers the tubular film advantageously has a fold inset on each side. In one preferred embodiment of the invention, a tubular film or a side-gusseted tube in the form of a film sheet is drawn over the stack of objects. To this end, it is recommended that the tubular film be welded in a manner known per se.

The rotatable support preferably has a film welder by means of which one end of the film section stored in the film storer may be welded closed. It is within the scope of the invention that the film welder, as a component of the rotatable support, together with the rotatable support is rotatable relative to the base. It is also within the scope of the invention that the end of the film section stored in the film storer is welded such that a hood-shaped film section, i.e. a film sheet, is formed. The film welder advantageously includes two welding bars that may be moved relative to one another.

It is recommended that the rotatable support has an opener for opening the film section or tubular film section stored in the film storer. It is understood that the film section or tubular film section is opened before covering the stack of objects. The opener, as a component of the rotatable support, together with the rotatable support is rotatable relative to the base. It is recommended that the opener is designed as a suction opener having a plurality of suction side plates.

It is within the scope of the invention that the film storer has at least one driving element movable transverse to the covering direction U of the film, for entraining the film transverse to the covering direction U of the film. In this manner the partial film sections entrained by the driving element are stored or temporarily stored in the film storer. The at least one driving element is preferably a looping roller.

One particularly preferred embodiment of the invention is characterized in that at least one driving element is movable in a first direction transverse to the covering direction U of the film, so that two first oppositely situated partial film sections of the film entrained by the driving element may be stored in the film storer, the driving element being deflectable and movable in a second direction opposite the first direction and transverse to the covering direction U of the film, so that further partial film sections of the film entrained by the driving element may be stored in the film storer. The partial film sections, i.e. the deflected partial sections of the film, also complement the film section stored in the film storer. At least two driving elements, i.e. two driving elements according to the very preferred embodiment of the invention described above, are provided.

According to one recommended embodiment of the invention, the film storer has at least one continuous belt, at least one driving element for the film being fixed to the continuous belt, and the driving element entraining the film transverse to the covering direction U of the film when the continuous belt moves. The above-described storage of partial film sections or of the film section is carried out in this manner. The continuous belt may be a chain, a toothed belt, or the like. It is within the scope of the invention that the continuous belt be guided over two deflection rollers or cylinders, at least one deflection roller or cylinder being driven and thus functioning as a drive roller or cylinder for the continuous belt.

One very recommended embodiment is characterized in that at least one first driving element is on the upper stretch of the continuous belt and at least one second driving element is on the lower stretch of the continuous belt, and when the continuous belt moves, the first driving element for entraining the film transverse to the covering direction U of the film is movable to the right, and the second driving element for entraining the film transverse to the covering direction U of the film is movable to the left. In this manner, each of the two driving elements causes two oppositely situated partial film sections to be stored. As described above, the driving elements are preferably looping rollers. It is within the scope of the is invention that the above-mentioned partial film sections and the partial film sections deflected at the driving elements are complementary to the film section stored in the film storer. One particularly preferred embodiment of the invention is characterized in that the driving element initially moved to the right passes around the first deflection roller of the continuous belt and is then preferably moved to the left, transverse to the covering direction U of the film, and the driving element initially moved to the left passes around the second deflection roller of the continuous belt and is then preferably moved to the right, transverse to the covering direction U of the film. The first driving element previously on the upper stretch moves to the lower stretch of the continuous belt, and the second driving element previously on the lower stretch moves to the upper stretch of the continuous belt. In this embodiment, each driving element produces two additional oppositely situated partial film sections. A relatively long film section is thus stored in the film storer. In principle, the embodiments explained above with regard to the continuous belt also function without a continuous belt when in these embodiments the driving elements are moved in the described manner by other means, i.e. means known to one skilled in the art.

At least one guide roller, preferably a plurality of guide rollers, for the film is preferably on the upper stretch of the continuous belt, and/or at least one guide roller, preferably a plurality of guide rollers, for the film is preferably on the lower stretch of the continuous belt. It is within the scope of the invention that the guide rollers are fixed to the continuous belt and are moved with the continuous belt. The purpose of the guide rollers is to prevent the partial film sections from lying directly on top of one another after the deflection operation or deflection operations, since otherwise they would interfere with one another or would interfere with the film storer.

It is recommended that the film-feed head is movable in the covering direction U of the film and opposite the covering direction U of the film. The base and the rotatable support, as components of the film-feed head, are then movable together with the film-feed head. The film-feed head is advantageously vertically movable. It is recommended that the film-feed head as well as the pull-down device are movable on vertical posts, preferably on only two vertical posts. At least one film storer is preferably between the film supply and the film-feed head. The film storer is used for accommodating or for storing film when the film-feed head moves in the covering direction U, and for dispensing film when the film-feed head moves opposite the covering direction U.

To achieve the object, the invention also teaches a method of wrapping stacks of objects with film. This method comprises the steps of pulling a tube of the film from a supply to a feed head above a stationary wrapping station and displacing the objects one after the other into and out of the wrapping station in a conveying direction with a long longitudinal dimension of some of the objects forming a first group generally parallel to the direction and the long longitudinal dimension of others of the objects forming a second group transverse to the direction. For each of the objects of one of the groups, a leading end section of the film is pulled straight through the feed head and then down over the object and the leading section is cut off. For each of the objects of the other of the groups, a leading end section of the film is looped in a storer in the film head and the looped leading end section is cut off. Then the storer and the looped and cut-off leading end section are rotated through at least 90° about a vertical axis, and the looped and cut-off leading end section is pulled down out of the storer over the object.

It is within the scope of the invention that one end, i.e. the upper or trailing end, of the film section stored in the film storer is welded while the rotatable support is rotated. The weld seam formed in this manner is advantageously cooled during rotation of the rotatable support. It is recommended that for the subsequent covering operation, the film section or tubular film section is opened during or after the rotation of the rotatable support. In addition, it is understood that the rotatable support may be rotated back, in particular rotated back by 90°, when a stack of objects that is in turn rotated by 90° is to be wrapped.

The invention is based on the discovery that by using the apparatus according to the invention and the method according to the invention, consecutively supplied stacks of objects having different orientations may be wrapped in a simple, less complicated, and operationally reliable manner. It is emphasized in particular that a change from a wrapping of a first stack of objects to a wrapping of a second, differently oriented stack of objects is possible in a rapid, less complicated, and operationally reliable manner. The apparatus according to the invention is characterized by a relatively simple and less complex design. It is also emphasized that existing devices may be retrofitted with the components according to the invention in a relatively simple and economical manner. The apparatus according to the invention is also characterized by extremely low susceptibility to malfunctions.

BRIEF DESCRIPTION OF THE DRAWING

The above and other objects, features, and advantages will become more readily apparent from the following description, reference being made to the accompanying drawing in which.

DETAILED DESCRIPTION

Figure 1:
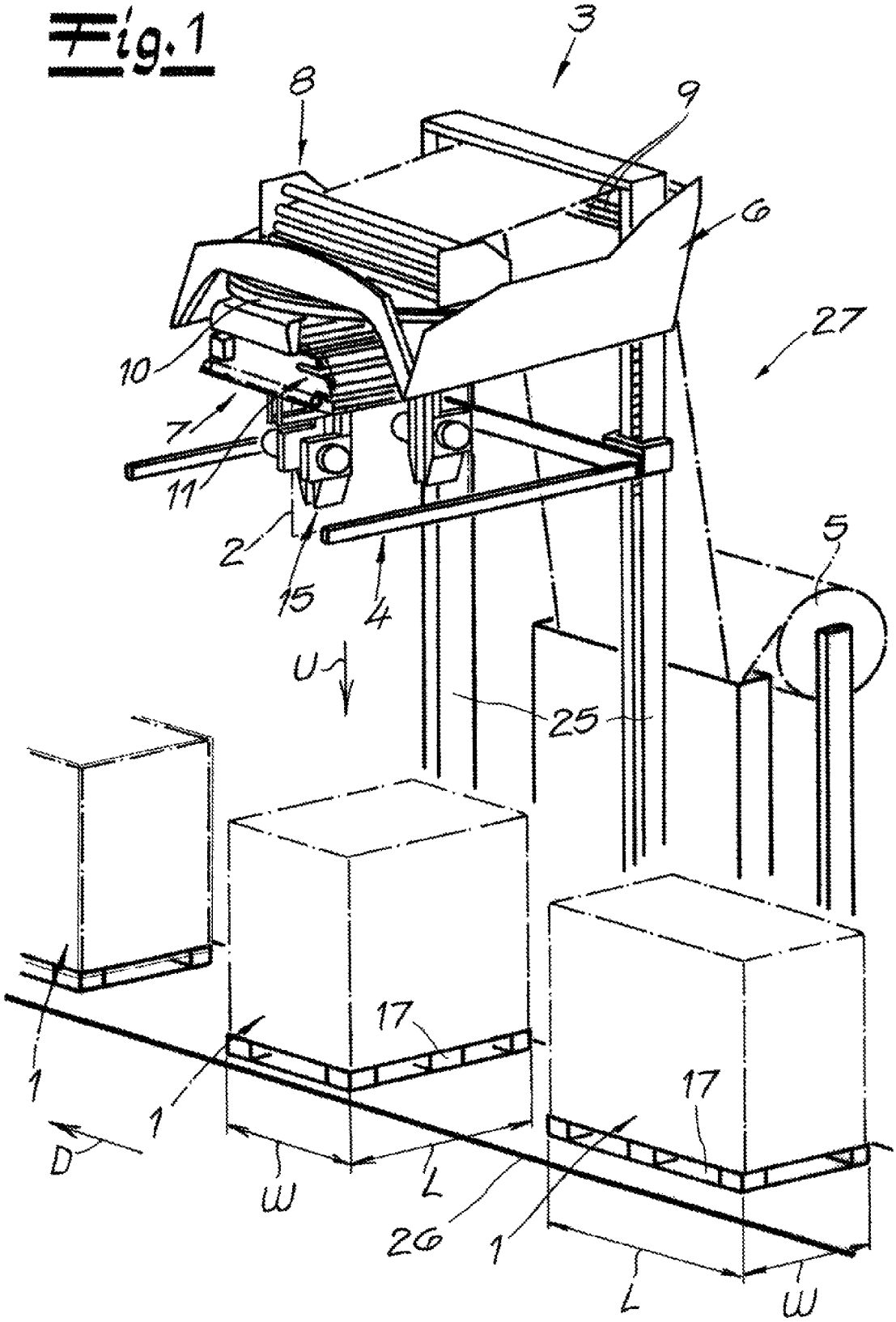
FIG. 1 is a perspective view of an apparatus according to the invention for wrapping a stack of objects.

As seen in FIG. 1, an apparatus for wrapping a stack 1 of objects with a film 2 has a film-feed head 3 for feeding the film 2 and a pull-down device 4 for subsequently covering the stack 1 with the film 2, typically by pulling it down over the stack 1. The device 4 can be moved up and down on vertical posts or columns 25 by an unillustrated actuator, and the head 3 is mounted at the tops of the posts 25. The apparatus also has a film supply in the form of a film coil 5 from which the film 2 is fed to the film-feed head 3. The stacks 1 are moved horizontally past a wrapping station 27 formed by the apparatus according to the invention in a transport direction D by a conveyor shown schematically at 26.

Figure 2:
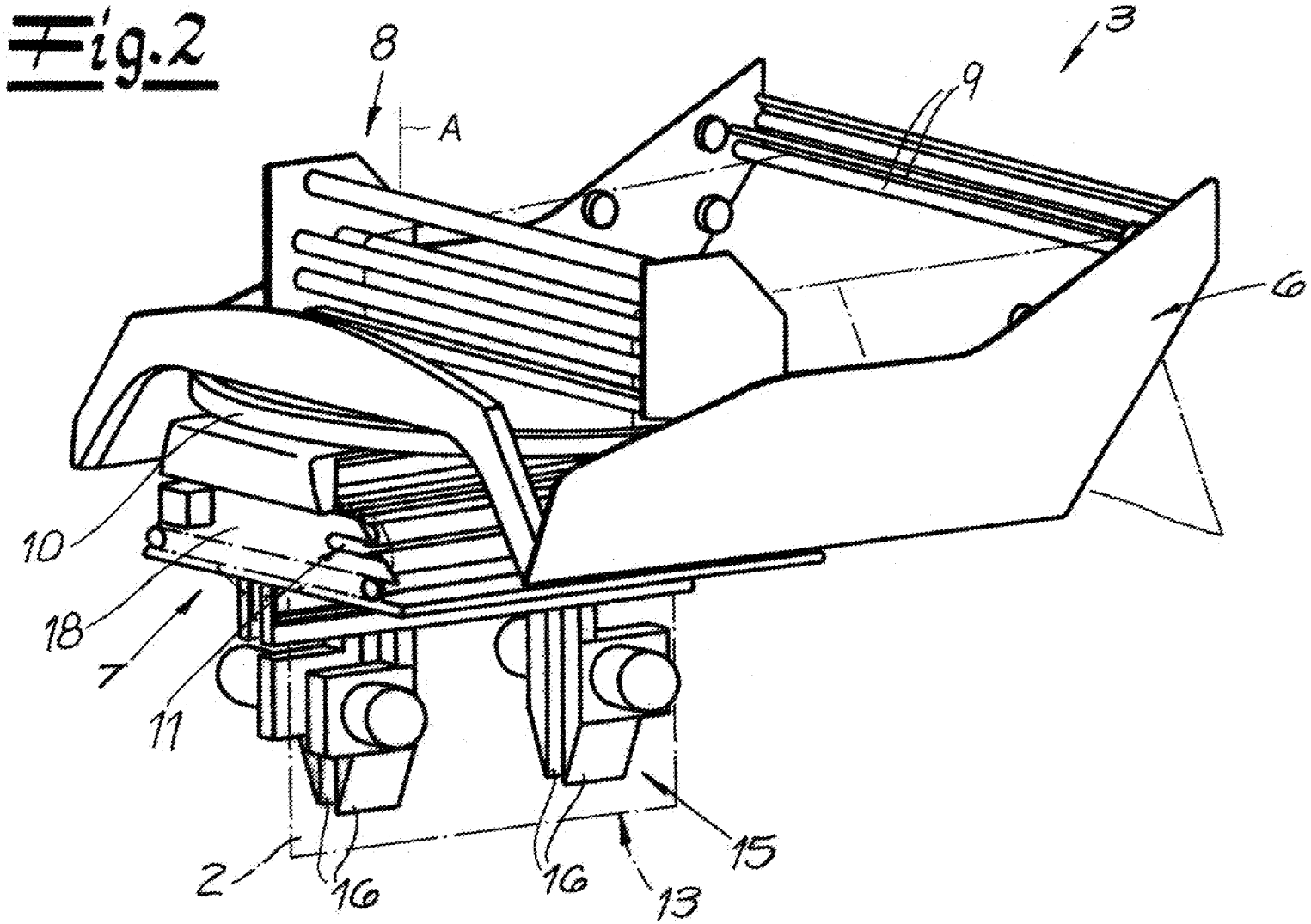
FIG. 2 is a perspective view of the film-feed head of the apparatus according to the invention.

According to the invention as also shown in FIG. 2, the film-feed head 3 has a base 6 and a support 7 rotatable about a vertical axis relative to the base 6. Here the rotatable support 7 is underneath the base 6. The base 6 includes a film feeder 8 for pulling the film 2 off the spool 5 and advancing it to the rotatable support 7. The base 6 also has guide rollers or deflection rollers 9 for the film 2. Preferably the film 2 is a tube, in particular with side gussets.

The rotatable support 7 has a guide ring 10 connected to the base 6 and a film storer 11 carried on the rotatable support 7 underneath the guide ring 10 and whose function according to the invention is described in more detail below. The rotatable support 7 is also equipped with a film cutter in the form of a blade 12 that can cut a section 13 that may be tubular from the film 2. The rotatable support 7 also has a film welder in the form of two welding bars 14. Using this film welder or these welding bars 14, an upper end of the film section 13 may be welded together, to form a hood-shaped film section 13, or for a simple flat film 2 a simple sheet. This hood-shaped film section 13 or this film sheet is then pulled down over the stack 1 by the device 4. To this end, the rotatable support 7 also has an opener 15 for spreading the film section 13 or the tubular film section. Preferably and here the opener 15 includes suction side plates 16 known per se for opening the tubular film.

The apparatus according to the invention is used for wrapping stacks of objects 1 that in cross section or top view are not square, that is that are of different horizontal width W and length L dimensions where $W \neq L$, and that are usually carried on pallets 17 that likewise in cross section or top view are not square. The instant invention is particularly applicable to a situation where as illustrated a nonsquare stack 1 or a nonsquare pallet 17 having for instance its width dimension W extending parallel to the conveying direction 26 is followed by a stack 1 having its length direction L parallel to the transport direction 26, that is they are rotated relative to one another about respective vertical axes by 90°. In principle, the two consecutively supplied stacks 1 and the respective pallets 17 described above may thus have the same dimensions or sizes. Here they are rotated with respect to one another only by 90°. To allow the film 2 or the tubular film to then be fed without constraint, according to the invention the rotatable support 7 is rotatable relative to the base 6 of the film-feed head 3, here by 90° so that it can align with the workpiece stack 1.

The film storer 11 has two endless belts 19 carried on respective horizontally confronting end walls 18 of the support 7 and supporting two looping rollers 20 for the film 2 that extend between the continuous belts 19 and between the end walls 18 of the rotatable support 7. In addition, guide rollers 21 for the film 2 are fixed to the continuous belts 19, and likewise extend parallel to the rollers 20 between the end walls 18 of the rotatable support 7. The continuous belts 19 are themselves spanned over two deflection rollers 22, at least one of which is is driven by an unillustrated motor carried on the support 7, and both of which are journaled permanently in the two end walls 18. Here the continuous belts 19 are chains, and the drive deflection roller 22 carries sprockets that mesh with the chains. Only one end wall 18 and only one continuous belt 19 are visible in FIGS. 3 through 6.

Thus the system operates as follows:

The film 2 here is of the side-gusset type comprising a tube with two folded-in side gussets so that the tube as shown in FIG. 1 has a width equal to somewhat more than the long dimension or length L of the stacks or packages being wrapped, and the gussets, open up to a dimension equal to the short dimension or width L of the stacks or packages being wrapped.

Figure 3:
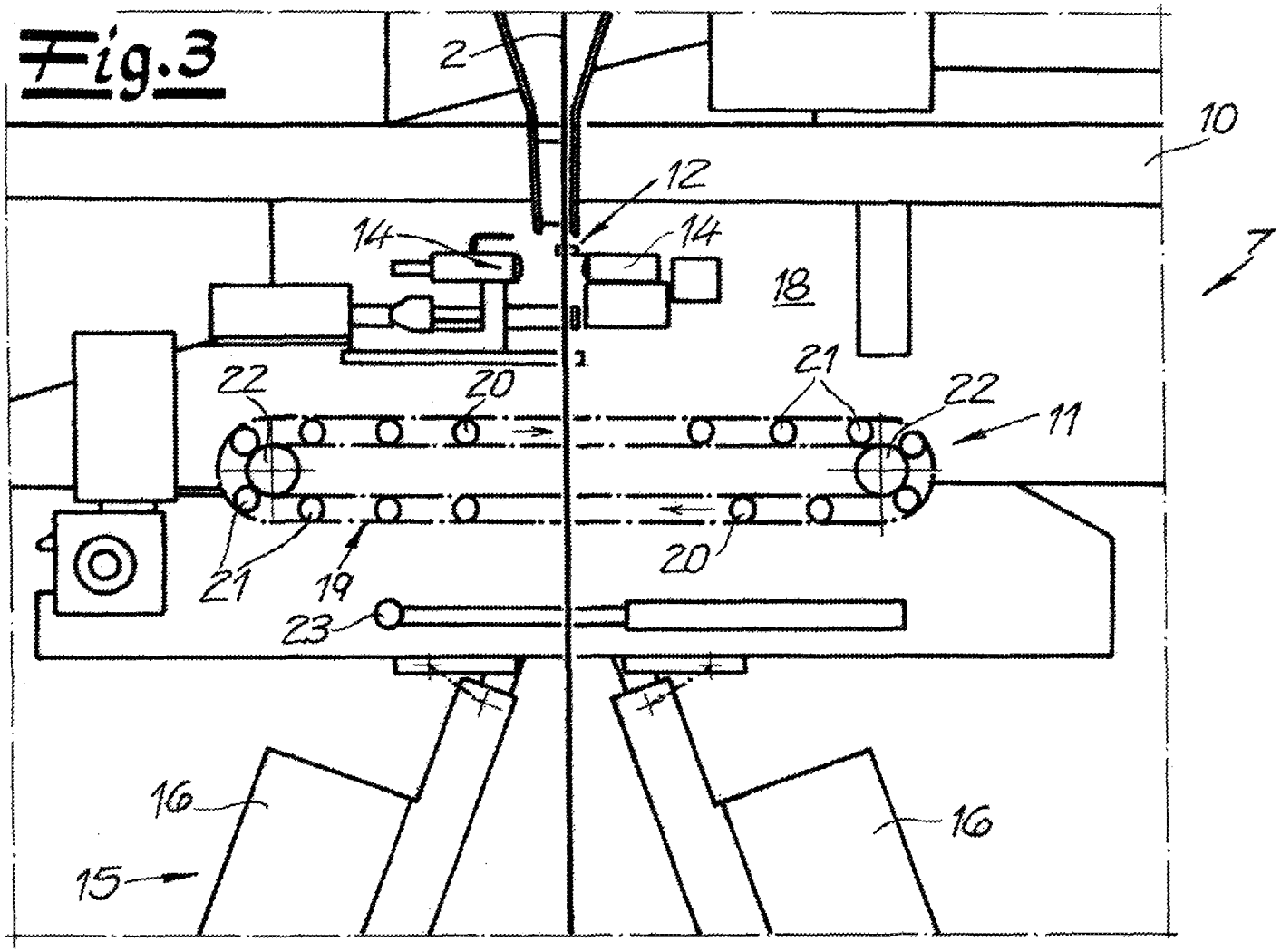
FIG. 3 is a cross-sectional side view of the film-feed head in a first position.

Thus for wrapping a package 1 whose length L is parallel to the conveyor direction 2, the film 2 is fed from the feeder 8 to the base 6 of the rotatable support 7, and specifically, past the film blade 12 and the welding bars 14, and through the film storer 11 until reaching the opener 15. The end of the film 2 is advantageously conveyed to the lower edges of the suction side plates 16. The suction side plates 16, which in FIG. 3 are separated, are then brought together so that the film 2 is gripped and cannot advance between them. Then the device 4, which has gripped the leading end of the cut-off film section 13, is pulled down on the columns 25 so that the spread tube section 13 is fitted over the package 1. When a section of the film tube 2 sufficient to cover the entire package 1 has passed through the cutter 12, the bars 14 are closed and the cutter 12 is operated to weld closed the upper end of the section and cut the section off the tube 2. Typically after being pulled over the stack or package 1, the tube section 2 is heat shrunk either in the wrapping station 27 or downstream, or the tube section may be elastically stretched as it is pulled down and released to engage tightly around the package 1. This is all generally standard.

Figure 4:
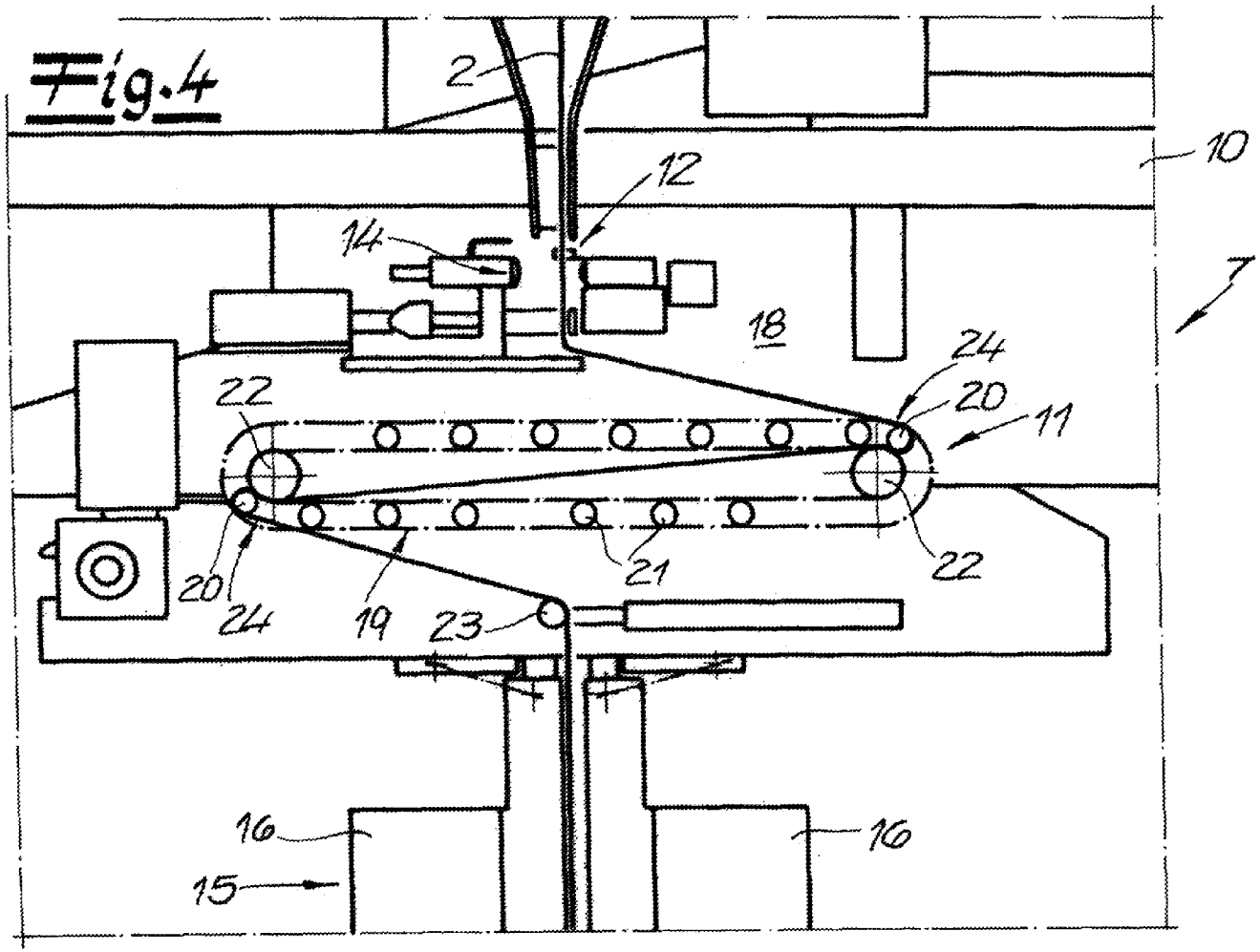
FIG. 4 is the structure of FIG. 3 in a second position.

When, however, a package arrives at the wrapping station 27 offset by 90° the film 2 is fed through the storer 11 to the suction side plates 16 that are then closed. The film storer 11 is then started by moving the belts 19 such the looping roller 20 on the upper stretches of the continuous belts 19 carries the film 2 along to the right, and the looping roller 20 on the lower stretches of the continuous belts 19 carries the film 2 along to the left (FIG. 4). In the lower region of the film storer 11, the film 2 passes over a film-guide roller 23 movable transverse to a covering direction U of the film 2. In the position of FIG. 4, two opposite film sections 24 are engaged around the looping rollers 20 and are stored in the film storer 11.

Figure 5:
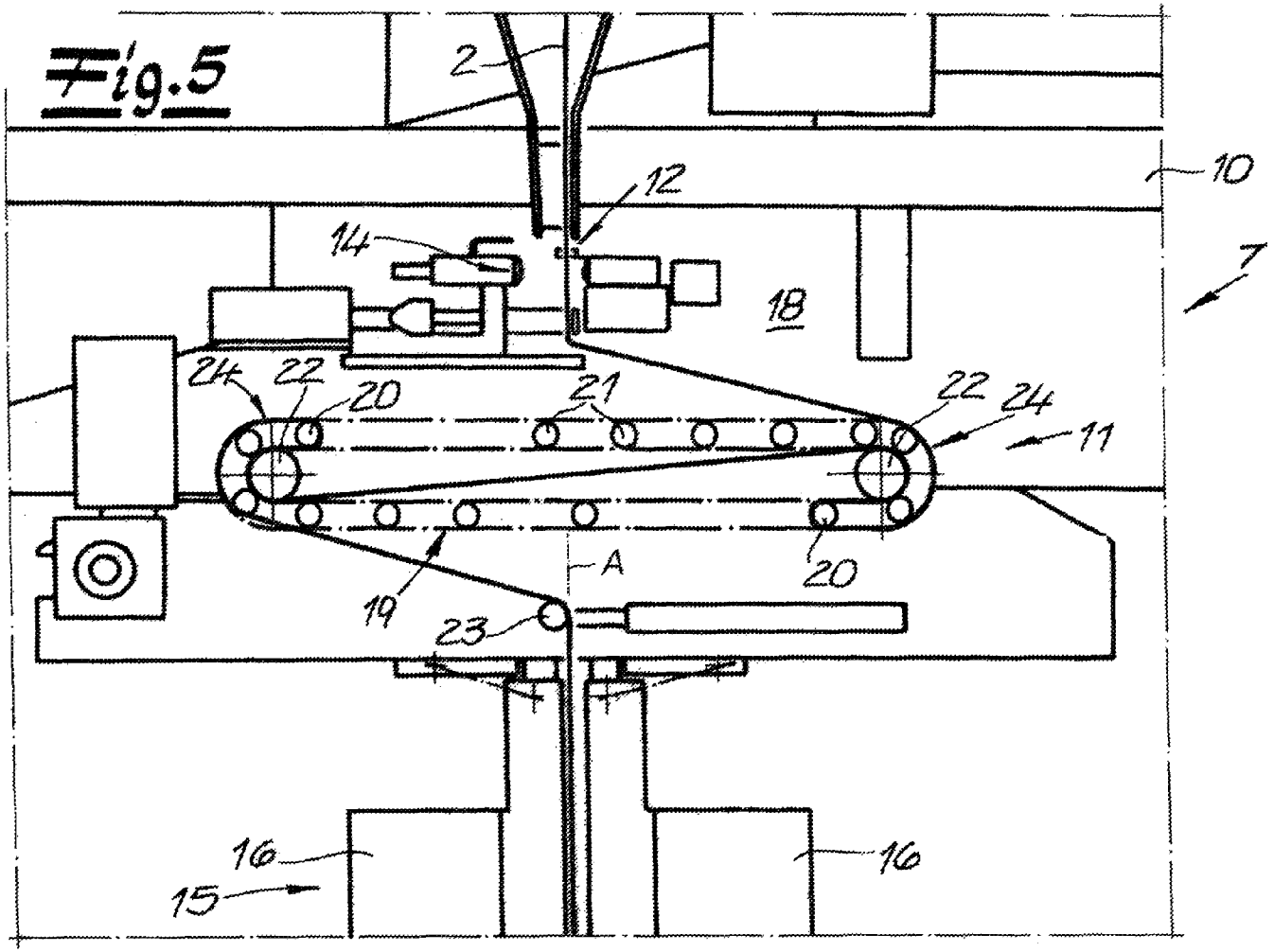
FIG. 5 is the structure of FIG. 3 in a third position.
Figure 6:
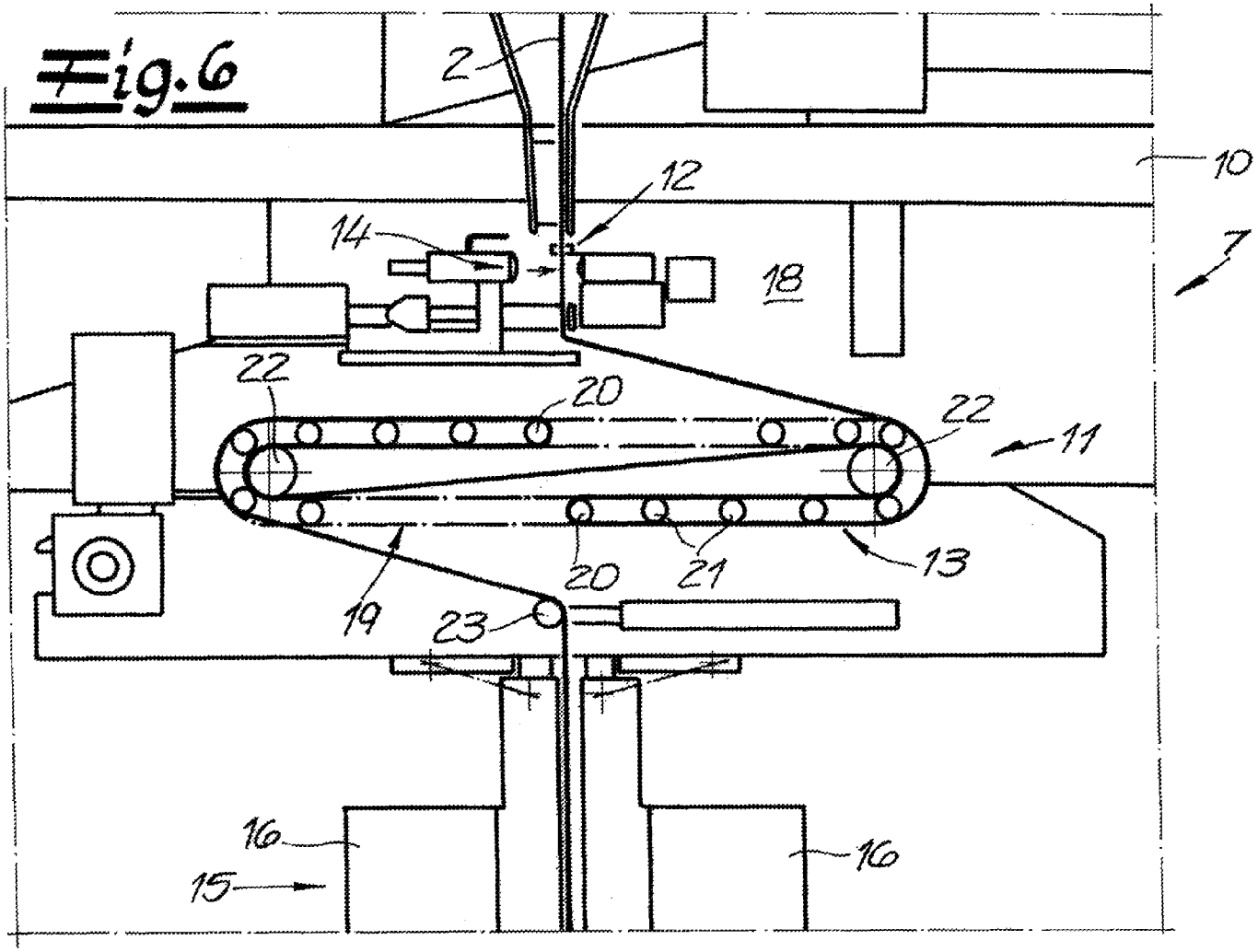
FIG. 6 is the structure of FIG. 3 in a fourth position.

The looping rollers 20 continue to move around the deflection rollers 22 of the continuous belts 19 so that the looping roller 20 previously on the upper stretches moves to the lower stretches, and the looping roller 20 previously on the lower stretches moves to the upper stretches (FIG. 5). The looping rollers 20 are moved further along the upper stretches and the lower stretches toward the center of the film storer by corresponding movement of the continuous belts 19, resulting in the position illustrated in FIG. 6. The partial film sections 24 situated or stored in this manner in the film storer 11 have a total length that is considerable, and easily enough to reach from the top to the bottom of a relatively tall object or stack 1.

After the desired length of film has been stored (FIG. 6), the film feeder 8 and the continuous belts 19 are stopped. The bars 14 for welding the film section 13 are then closed, and the film section 13 is separated from the remaining film 2 by the film blade 12. This is followed by rotation of the rotatable support 7 or the rotation of the guide ring 10 of the rotatable support 7. The rotatable support 7 is advantageously rotated by 90° during the welding process and during cooling of the produced weld seam. Rotation of the support 7 with the storer 11 therefore aligns the stored tube 2 with the crosswise workpiece 1 as shown in FIGS. 1 and 2.

For the covering operation, the film section 13 is opened by the opener 15 or by the suction side plates 16, and, as the result of reverse movement of the continuous belts 19, the film storer 11 releases the film section 13, and, the pull-down device 4 draws the film section 13 down over the stack 1. This is not illustrated in greater detail in the figures.

We claim:

1. An apparatus for wrapping a tubular film around each of a sequence of objects passing sequentially through a wrapping station, the apparatus comprising:

a supply of the film adjacent the station;

a feed head at the station having a base;

a support carried on the base and rotatable relative thereto about a vertical axis;

means on the base for pulling the film off the supply and feeding it in a travel direction to the support;

a film storer carried on the rotatable support and operable to take in and store a length of film fed to the support by the means;

means on the rotatable support for cutting the film upstream in the travel direction of the film storer and thereby leaving a leading-end section of the film in the film storer;

a welder on the rotatable support above the film storer for closing a trailing end of the section of the film; and a pull-down device in the station vertically displaceable below the feed head.

2. The apparatus defined in claim 1 wherein the support is pivotal about the axis between two positions offset by at least 90°.

3. The apparatus defined in claim 1, further comprising an opener on the support downstream of the film storer and upstream of the pull-down device for spreading the tubular film.

4. The apparatus defined in claim 1 wherein the film storer has at least one looping element movable transversely of the travel direction of the film from the means for pulling to the pull-down device.

5. The apparatus defined in claim 1 wherein the film storer has two of the looping elements movable transversely of a travel direction of the film from the means for pulling to the pull-down device, and means for oppositely shifting the looping elements and thereby forming loops in the film.

6. The apparatus defined in claim 5 wherein the means for oppositely shifting includes at least one endless belt spanned over two deflecting rollers flanking the film and spaced apart transversely of the travel direction of the film, the belt carrying the looping elements.

7. The apparatus defined in claim 6 wherein the belt has upper and lower stretches each carrying a respective one of the looping elements such that advancement of the belt moves the looping elements in opposite directions.

8. The apparatus defined in claim 7 wherein when the looping elements pass over the deflection rollers they reverse direction.

9. The apparatus defined in claim 8 wherein the belt carries a plurality of guide elements extending parallel to the looping elements.

10. The apparatus defined in claim 8 wherein the feed head is vertically shiftable in the station.

11. A method of wrapping a sequence of objects of non-square footprint with a tubular film, the method comprising the steps of:

pulling a tube of the film from a supply to a feed head above a stationary wrapping station;

displacing the objects one after the other into and out of the wrapping station in a conveying direction with a long longitudinal dimension of some of the objects forming a first group generally parallel to the direction and the long longitudinal dimension of others of the objects forming a second group transverse to the direction;

for each of the objects of one of the groups, pulling a leading end section of the film straight through the feed head and down over the object and cutting off the leading section in the feed head;

closing a trailing end of the cut-of leading section by welding in the feed head; and for each of the objects of the other of the groups, looping a leading end section of the film in a storer in the feed head, cutting off the looped leading end section in the feed head, closing a trailing end of the cut-off looped leading end section by welding in the feed head, rotating the film storer and the looped, welded, and cut-off leading end section through at least 90° about a vertical axis, and pulling the looped, welded, and cut-off leading end section down out of the film storer over the object.

12. The method defined in claim 11 wherein the film storer is carried on a support rotatable about the vertical axis on the base, the objects of the one group being wrapped with the support in a starting position and the objects of the other group being wrapped with the support in a crosswise position offset by at least 90° about the axis from the starting position.

13. The method defined in claim 12, further comprising the step for all of the objects of spreading a leading end of the cut-off tube section before pulling it down over the object.

14. The method defined in claim 12, wherein the film storer and a welder for welding the section are rotated with the feed head.

15. The method defined in claim 14, wherein the welding is carried out during rotation of the feed head.

* * * * *